US005424123A

United States Patent [19]

Geirhos et al.

[11] Patent Number: 5,424,123

[45] Date of Patent: Jun. 13, 1995

[54] INTERMINGLED MULTIFILAMENT YARN COMPRISING HIGH MODULUS MONOFILAMENTS AND PRODUCTION THEREOF

[75] Inventors: Josef Geirhos, Bobingen; Ingolf Jacob, Untermeitingen, both of Germany

[73] Assignee: Hoechst Aktiengesellschaft

[21] Appl. No.: 108,227

[22] Filed: Aug. 19, 1993

Related U.S. Application Data

[62] Division of Ser. No. 692,215, Apr. 26, 1991, Pat. No. 5,293,676.

[30] Foreign Application Priority Data

Apr. 30, 1990 [DE] Germany ..... 40 13 946.8

[51] Int. Cl.[6] ..... D02G 3/00

[52] U.S. Cl. ..... 428/357; 428/370; 428/399; 57/243; 57/244; 57/245; 57/908

[58] Field of Search ..... 57/908, 243, 244, 245, 57/249; 428/364, 370, 373, 399, 357

[56] References Cited

U.S. PATENT DOCUMENTS

| | | | |
|---|---|---|---|
| 2,985,995 | 5/1961 | Bunting | 28/271 |
| 3,069,836 | 12/1962 | Dahlstorm et al. | 28/276 |
| 4,059,950 | 11/1977 | Negishi et al. | 428/399 |
| 4,115,988 | 8/1978 | Nakagawa et al. | 57/908 |
| 4,226,079 | 10/1980 | Mountney et al. | 57/244 |
| 4,295,329 | 10/1981 | Windley | 57/245 |
| 4,307,566 | 12/1981 | Murata et al. | 428/370 |
| 4,529,655 | 7/1985 | Palmer | 428/364 |
| 4,770,915 | 9/1988 | Nakagawa et al. | 428/399 |
| 5,293,676 | 3/1994 | Geirhos et al. | 28/276 |

OTHER PUBLICATIONS

Dictionary of Fiber & Textile Technology, 1965 pp. 81 and 32.

*Primary Examiner*—Patrick J. Ryan
*Assistant Examiner*—N. Edwards
*Attorney, Agent, or Firm*—Connolly & Hutz

[57] ABSTRACT

There is described an intermingled multifilament yarn comprising high modulus monofilaments made for example of aramid, carbon or glass and a process for producing this yarn. Conventional air intermingling is impracticable for high modulus yarns since they tend to break, because of their brittleness, which leads in particular to an appreciable reduction in the tenacity. The invention proposes carrying out the intermingling at elevated temperature—either by preheating the yarn or by heating the intermingling air. It is found, surprisingly, that, although the entanglement spacings are relatively low, the tenacity remains substantially unaffected and in some instances is even raised. The multifilament yarn produced by this process is noteworthy in particular for the low number of broken monofilament ends. The invention can also be applied to commingled yarns, yarns which are part high modulus filaments and part thermoplastic filaments.

9 Claims, 5 Drawing Sheets

INTERMINGLED MULTIFILAMENT YARN COMPRISING HIGH MODULUS MONOFILAMENTS AND PRODUCTION THEREOF

CROSS REFERENCE TO RELATED APPLICATION

This application is a division of our application Ser. No. 07/692,215, filed Apr. 26, 1991, now U.S. Pat. No. 5,293,676, issued Mar. 15, 1994.

FIELD OF THE INVENTION

The invention relates to a process for producing a multifilament yarn having a total linear density of 500–4000 dtex, preferably 700–3000 dtex, and consisting at least in part of high modulus monofilaments having an initial modulus of more than 50 GPa, preferably more than 80 GPa, in which the yarn is intermingled using an intermingling medium, in particular air, and to such a multi-filament yarn.

DESCRIPTION OF THE PRIOR ART

High modulus yarns comprising liquid-crystalline or special high polymers with largely inflexible chains such as aramid, carbon and glass are in general very stiff. The conventional process of air intermingling as used for example for increasing yarn cohesion or for mixing with other yarn components leads to considerable difficulties, in particular at high degrees of intermingling, since the monofilaments, because of their stiffness, are very difficult to intermingle and because of their brittleness tend to break, which results in particular in a considerable reduction in the tenacity. The cohesion of these yarns is then inadequate and, owing to the large number of broken monofilaments, it is not possible to produce a smooth fluffball-free yarn. Therefore, vigorous air intermingling of such high modulus yarns does not give commercially acceptable results.

SUMMARY OF THE INVENTION

It is an object of the present invention to provide a process for producing a high modulus multifilament yarn and a multifilament yarn of this type which is highly cohesive and very smooth and free of fluffballs. More particularly, a reduction in the tenacity due to the process of intermingling shall ideally be avoided.

This object is achieved according to the present invention by a process as classified at the beginning which comprises intermingling at a temperature of $(0.25–0.9)T_m$, where $T_m$ is the melting point or decomposition temperature of the high modulus monofilaments, measured in °C.

The multifilament yarn of the present invention exhibits an average entanglement spacing, measured in the pin count test (by means of the Rothschild Entanglement Tester 2050), of less than 150 mm and a number of broken monofilament ends which, measured by the light barrier method on one side of the yarn, is less than 20/m.

DETAILED DESCRIPTION

Figure 1:
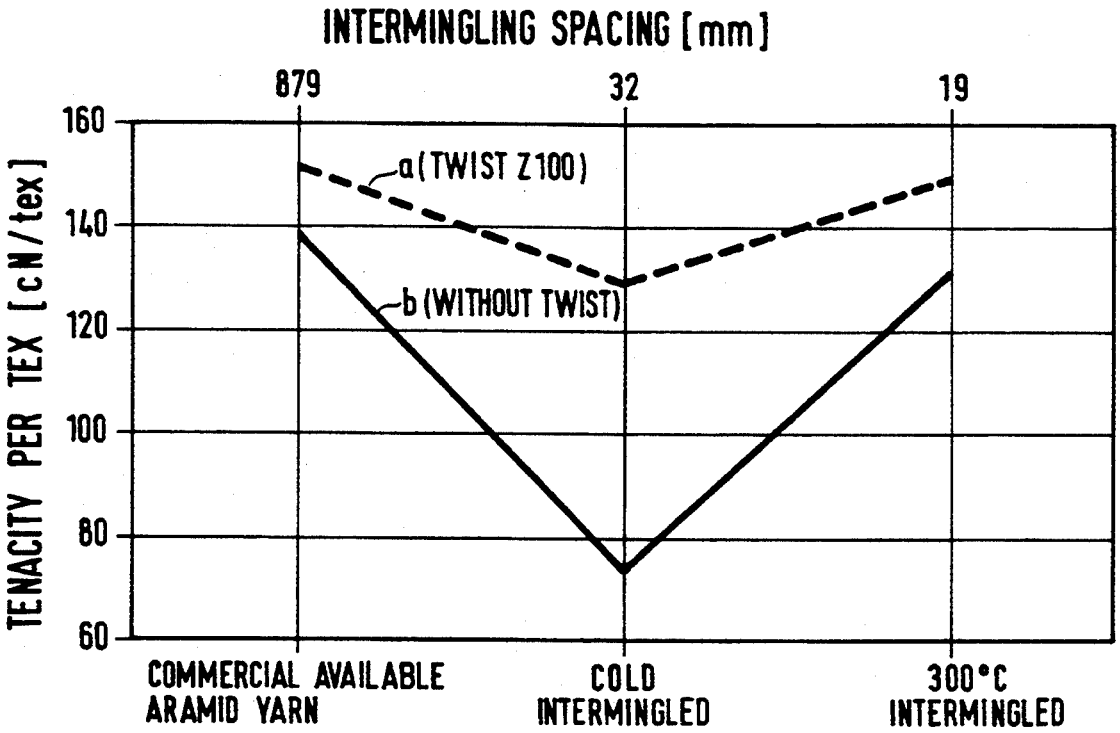
FIGS. 1 to 5 are graphical plots illustrating the relationship between the tenacity and the hot intermingling of the present invention for aramid multifilament yarns.

The basic intermingling U.S. Pat. No. 2,985,995 already contains the general statement that the intermingling of yarns can be carried out at elevated temperature and that in particular, if the yarn tension is too high and/or the pressure of the intermingling, or interlacing, medium is too low, a certain amount of plasticization of the yarn due to moistening and/or heating will promote intermingling. This concept is taken up in U.S. Pat. Nos. 3,069,836 and 3,083,523, in which polyester or polyamide yarns are intermingled with hot air to produce particularly low-shrinkage yarns. In EP Patent Specification 01 64 624 a polyester yarn is intermingled with hot air so that the yarn may be wound up in the hot state. DD (German Democratic Republic) Patent 240,032 finally describes the production of polyamide, polyester or polyolefin yarn wherein the yarn is treated with steam or moist hot air in a yarn cohesion means in order to impart satisfactory winding properties.

In contrast to this prior art, the present invention is based on the discovery that in the case of particularly high modulus multifilament yarns a process of hot intermingling, in contradistinction to cold intermingling, has virtually no reducing effect on the tenacity and may even lead to an increase in the tenacity. In fact, the invention makes it possible for the first time to produce a highly intermingled multifilament yarn of an initial modulus of more than 50 GPa which exhibits high cohesion, which is smooth and virtually fluffball-free, and whose tenacity is not significantly lower, if at all, than that of the unintermingled yarn.

Advantageously, the yarn is intermingled to such an extent that the average entanglement spacing of the yarn, measured in the pin count test, is less than 150 mm, preferably less than 70 mm or 50 mm.

The intermingling can be effected using conventional intermingling jets. The entanglement spacing or the entanglement density is primarily determined by the pressure of the intermingling medium and the specific type of jet. Therefore, in order to obtain a desired entanglement spacing, each type of jet must be operated at the right intermingling pressure. Advantageously, the working pressure is within the range of from 1 to 10 bar, preferably from 1.5 to 8 bar and in particular from 2 to 4 bar.

The intermingling temperature is preferably $(0.5–0.9)T_m$, in particular $(0.7–0.8)T_m$. If for example the high modulus monofilaments are made of aramid, the intermingling temperature is advantageously within the range of 200°–360° C., preferably 300° C. In the case of carbon the intermingling temperature should be between 200° and 500° C., preferably between 300° and 500° C. If the high modulus monofilaments are made of glass, the intermingling temperature is 300°–600° C., preferably 300°–500° C.

Prior to intermingling, the high modulus monofilaments can be heated to the intermingling temperature, which may be done by heating with a godet, heating panel, heating pipe, radiative heating under pretension or hot air. If the entire yarn consists of high modulus monofilaments, then the intermingling medium may likewise be heated to the intermingling temperature.

The invention is applicable not only to one-component yarns but also to commingled yarns, yarns combined of high modulus monofilaments and thermoplastic monofilaments having a lower initial modulus. The term "commingled yarn" is explained for example in Chemiefasern/Textilindustrie (Industrie Textilien), 39/91, T 185, T 186 (1989). In this case, only the high modulus monofilaments are preheated to the intermingling temperature, while the lower-melting thermoplastic monofilaments are not preheated and the intermingling medium is not heated either.

Suitable thermoplastic monofilaments of a low initial modulus are for example PEEK (polyether ether ketone), PEI (polyether imide), PET (polyethylene terephthalate) and PPS (polyphenylene sulfide).

As mentioned earlier, the number of broken monofilament ends in the multifilament yarn produced according to the invention is less than 20 per meter. Preferably, the number of broken ends is even less than 10/m and may even be virtually zero, in particular less than 3/m, very particularly preferably less than 0.1/m. The number of broken monofilament ends are measured using the customary light barrier method whereby the broken monofilament ends protruding on one side of the yarn are detected (for example with a Shirley Hairiness Meter, Shirley Institute, Manchester).

An important feature of the multifilament yarn formed according to the invention is that the tenacity is significantly higher than if the yarn had been subjected to cold intermingling. This is probably due on the one hand to the lower number of broken monofilament ends and on the other to a more advantageous orientation of the monofilaments. In the case of a one-component yarn which consists of high modulus monofilaments only, the tenacity of the intermingled yarn should be at least 80% of that of the unintermingled yarn. Frequently, it is even possible to obtain a tenacity of at least 90% and in certain cases of more than 100% of that of the unintermingled yarn.

Even in the case of commingled yarns the invention gives an increase in the tenacity compared with cold-intermingled yarns. In fact, the commingled yarns are likewise noteworthy for high cohesion and high smoothness which may even render the yarns useful for weaving.

Figure 4:
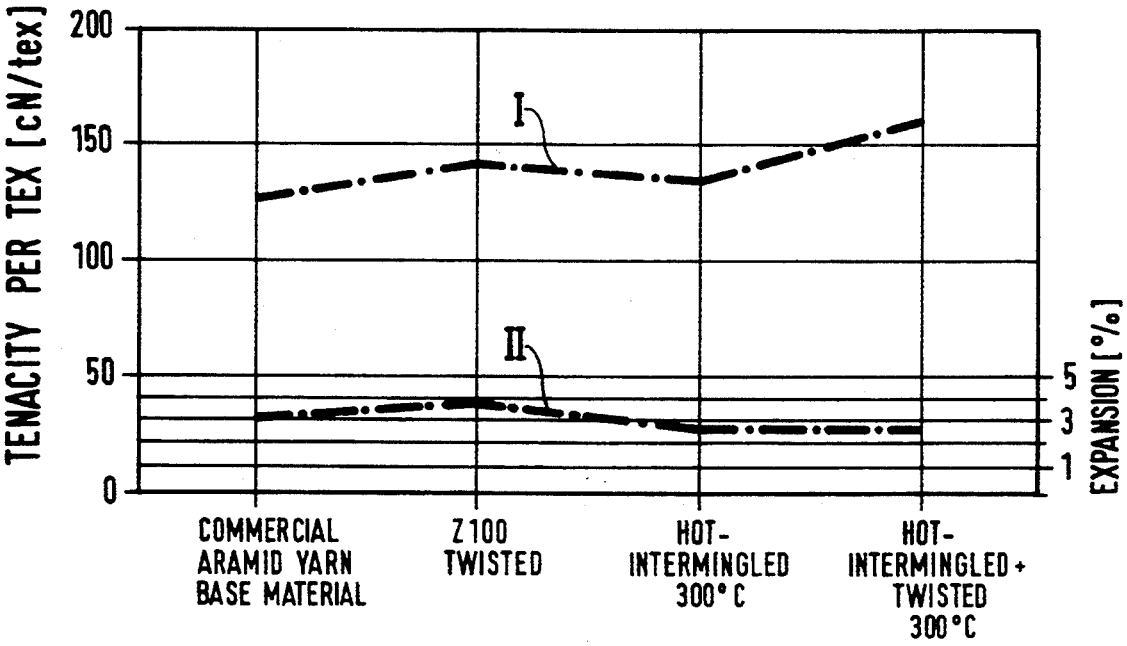
Figure 5:
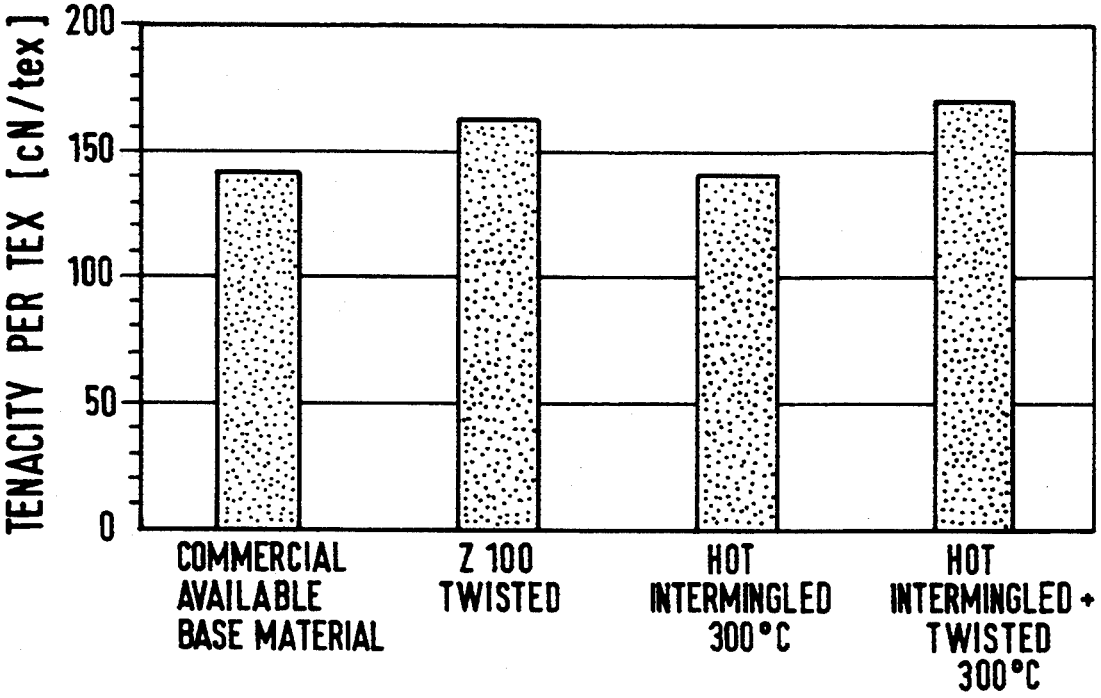
Figure 6:
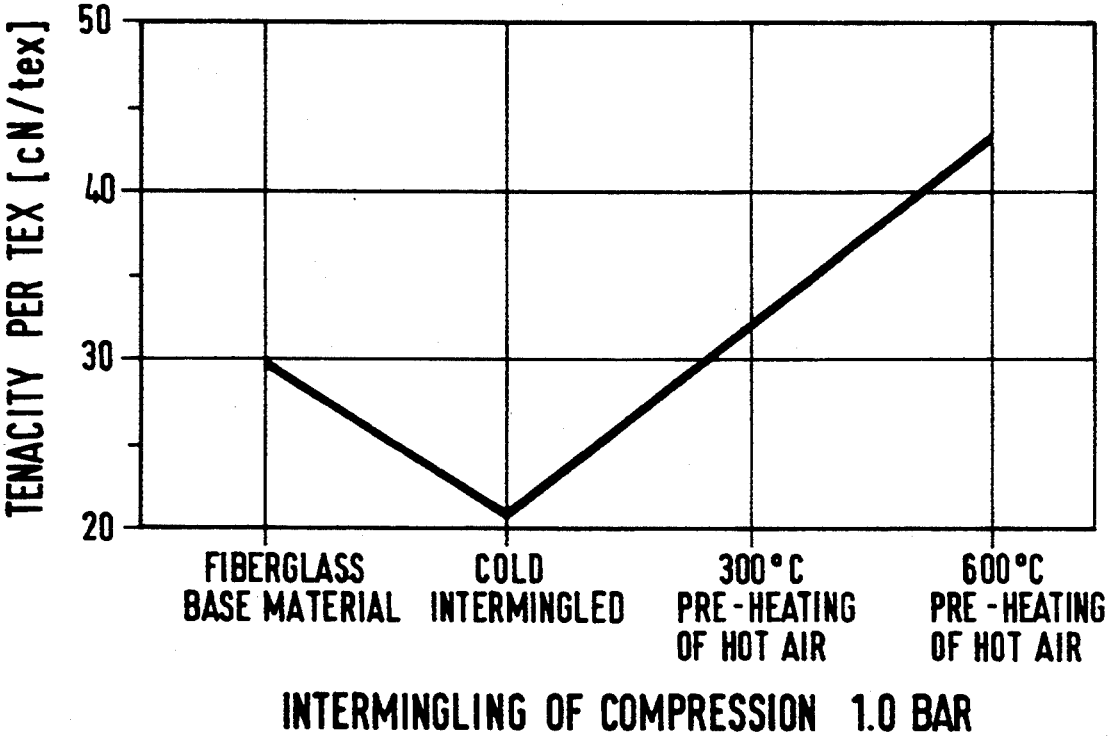
FIGS. 6 and 7 are graphical plots illustrating the relationship between the tenacity and the hot intermingling of the present invention for glass and carbon multifilament yarns.
Figure 7:
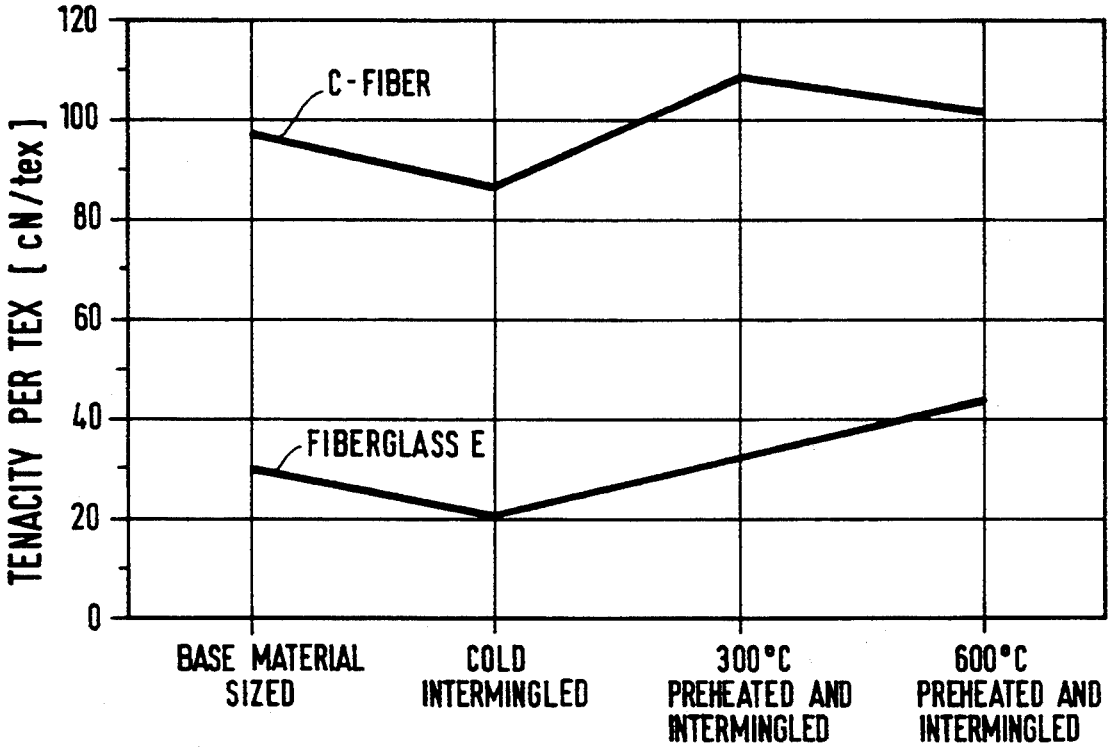
Figure 8:
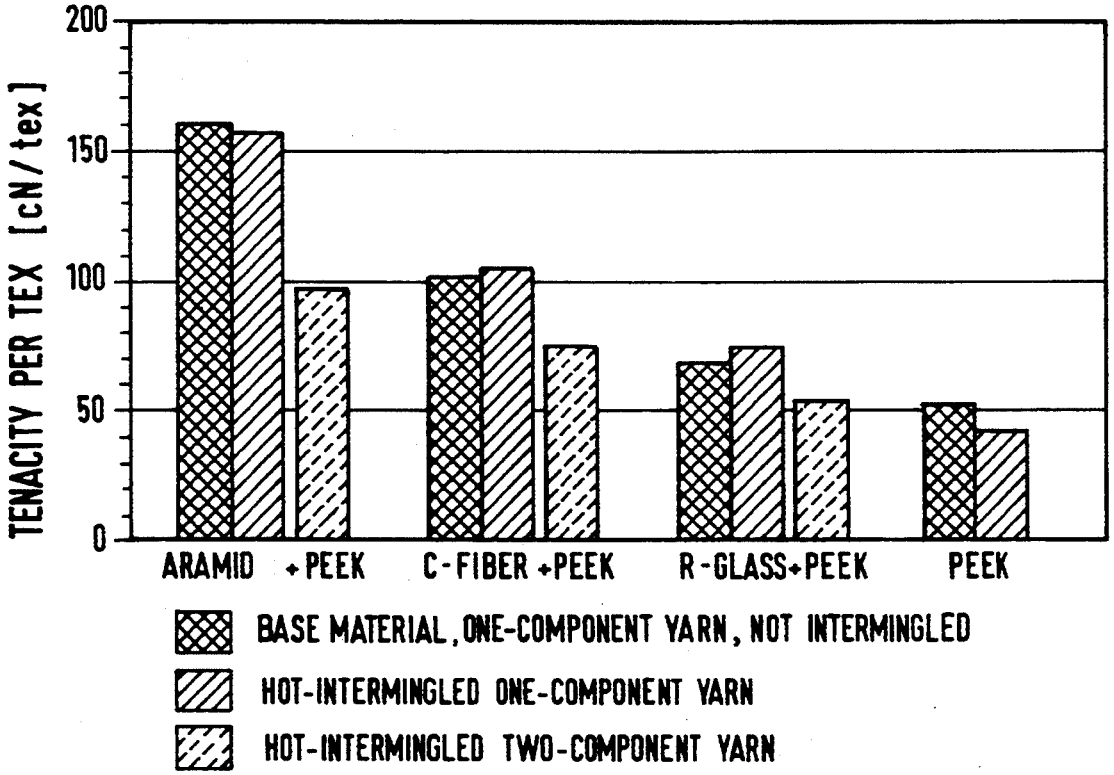
FIG. 8 is a graphical plot illustrating the tenacity of one-component and commingled yarns produced according to this invention.

Examples of the invention will be illustrated with reference to diagrams depicted in the Figures, of which FIGS. 1–5 show diagrams illustrating the relationship between the tenacity and the hot intermingling of the present invention for aramid multifilament yarns, FIGS. 6 and 7 show diagrams depicting the relationship between the tenacity and the hot intermingling of the present invention for glass and carbon multifilament yarns, and FIG. 8 shows a diagram depicting the tenacity of one-component and commingled yarns produced according to the invention.

The diagram of FIG. 1 shows the tenacity (in cN/tex) of a commercially available aramid yarn, the broken-line curve a applying to a yarn with 100 turns per meter of Z twist and curve b to a zero-twist yarn investigated for experimental purposes. The left-hand ends of the two curves relate to the unintermingled feed yarn, while the midpoints of the curves relate to a cold-intermingled yarn and the right-hand ends of the curves relate to a yarn produced according to the present invention by intermingling following preheating to 300° C.

As is clear from the two curves, the tenacity drops considerably on cold intermingling, while it remains essentially intact in the hot intermingling of the present invention. Underneath the diagram is a scale showing the entanglement spacing (in mm) of the yarn, amounting to 32 mm in the case of the cold-intermingled yarn and to 19 mm in the case of the hot-intermingled yarn.

Figure 2:
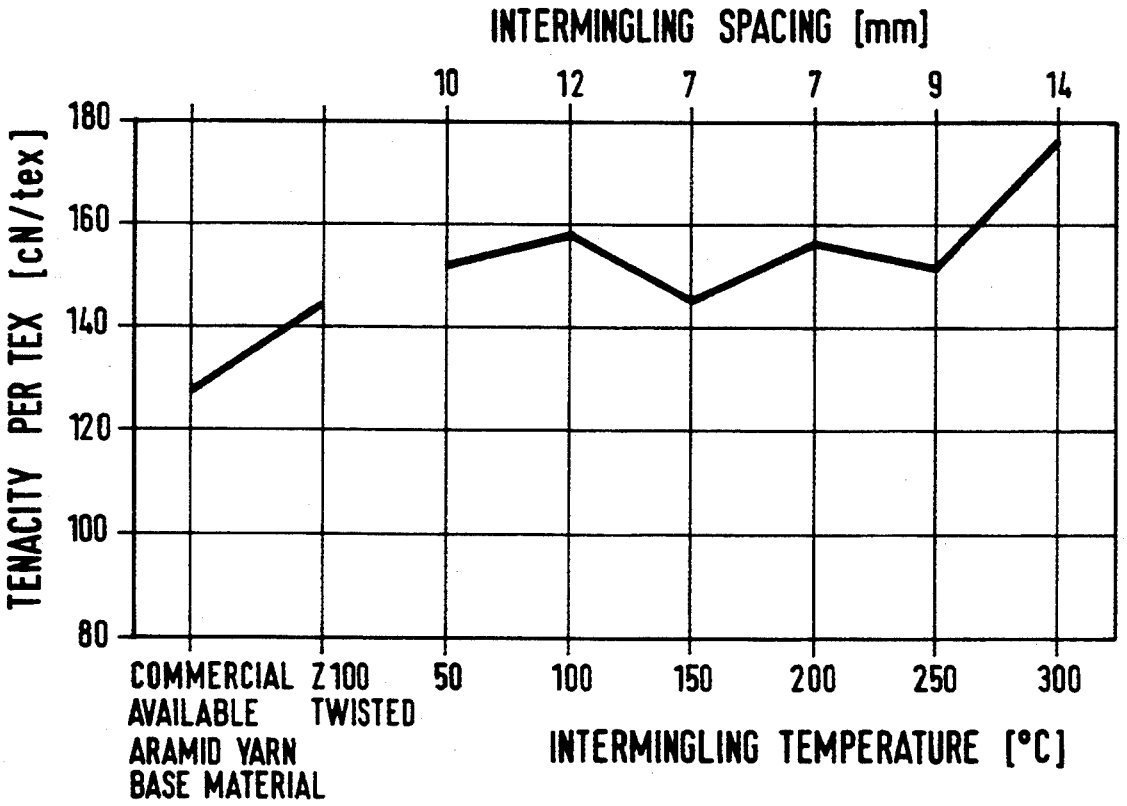

The diagram of FIG. 2 shows the relationship between the tenacity and the intermingling temperature, to be precise for a further commercially available aramid yarn with 100 turns per meter of Z twist. As can be seen, in this case the tenacity increases with the intermingling temperature. The entanglement spacing is substantially independent of the intermingling temperature.

Figure 3:
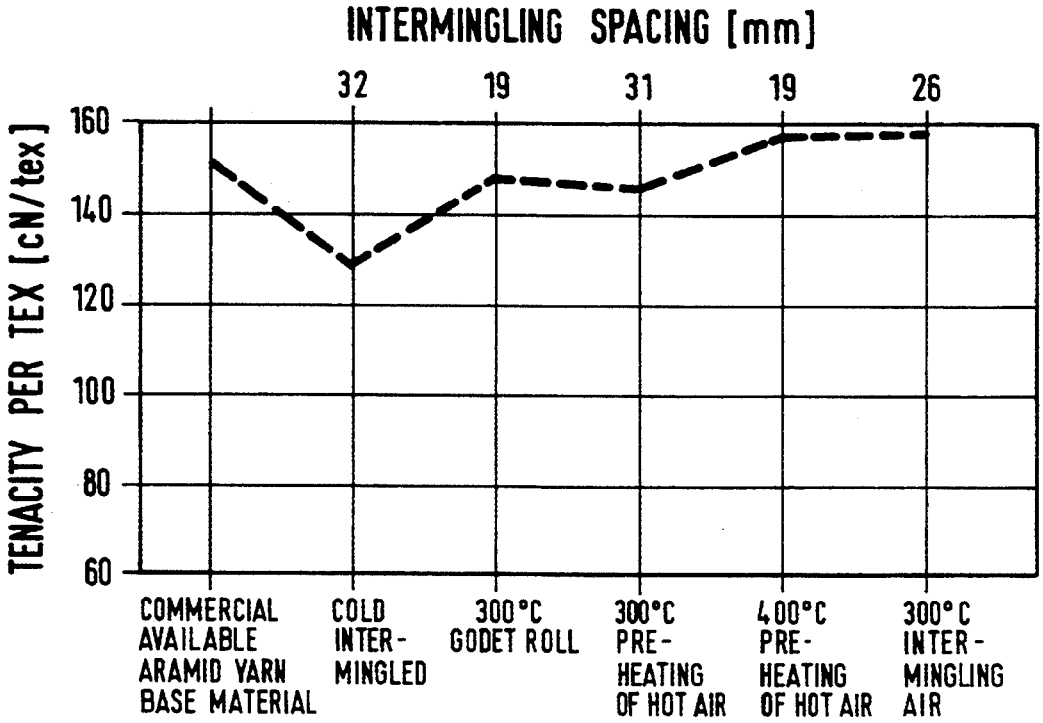

The diagram of FIG. 3 depicts the relationship between the tenacity and various heating methods for the aramid yarn used in FIG. 1. For instance, the yarn was preheated on a godet to 300° C. or with hot air to 300° C. and 400° C., or as a further possibility the intermingling air was heated to 300° C. It is again clear from this diagram that the tenacity decreases distinctly on cold-intermingling, while it remains virtually the same or increases on hot-intermingling according to the present invention.

The diagram of FIG. 4 includes in addition to the tenacity curve (curve I) the elongation curve (curve II, in %) for the aramid yarn used in FIG. 2. The four points of inflexion of the two curves apply respectively to the unintermingled feed yarn without twist, the unintermingled feed yarn with 100 turns per meter of Z twist and to the hot-intermingled yarn with and without twist. With this yarn too the process of hot-intermingling leads to a certain increase in the tenacity, while the extensibility remains virtually constant.

The diagram of FIG. 5 is a bar chart, corresponding to the series of measurements represented in curve I of FIG. 4, for a further commercially available aramid yarn. It can be seen from the bar chart that the intermingling according to the invention does not lead to a reduction in the tenacity. It can further be seen that on twisting the yarns (intermingled and unintermingled) the tenacity increases, this increase being greater for the intermingled yarn than for the unintermingled yarn.

The diagram of FIG. 6 depicts the tenacity of a multifilament yarn made of glass, once in the form of the untreated feed yarn, then in the form of a cold-intermingled yarn and finally in the form of the hot-intermingled yarn. In the case of hot-intermingling, the yarn was preheated with hot air, on one occasion to 300° C. and another occasion to 600° C. The intermingling pressure was 1.0 bar in both instances.

As can be seen from the diagram, cold-intermingling of a glass yarn likewise leads to a distinct decrease in the tenacity, while hot-intermingling preserves or even increases the tenacity.

The same relationship is illustrated in the diagram of FIG. 7, in which the lower curve applies to a glass yarn of type E and the upper curve to a carbon yarn.

The diagram of FIG. 8 depicts the tenacity for intermingled and unintermingled one-component yarns of various materials and also for various commingled yarns. The cross-hatched columns represent unintermingled yarns made of aramid, carbon, glass or PEEK. The slant-hatched columns apply to hot-intermingled yarns made of the same materials. The columns hatched with broken lines finally apply to commingled yarns made of aramid, carbon or glass, each of which was commingled with PEEK.

In all these diagrams, hot-intermingling was carried out at an intermingling temperature of 300° C., unless otherwise stated in the diagrams.

Figure 9:
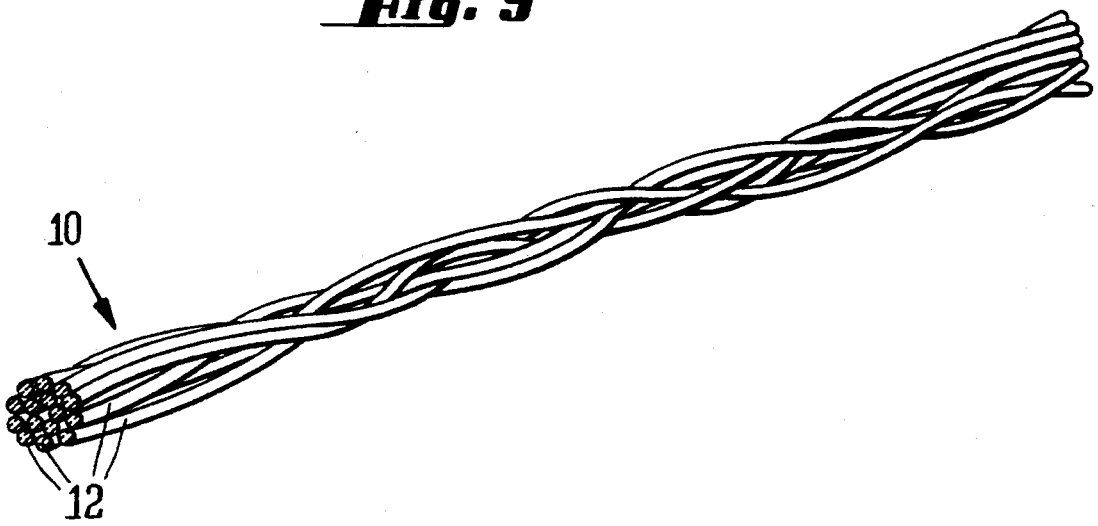
FIG. 9 illustrates a yarn, greatly enlarged, which has been produced in accordance with this invention and contains only high-modulus monofilaments.
Figure 10:
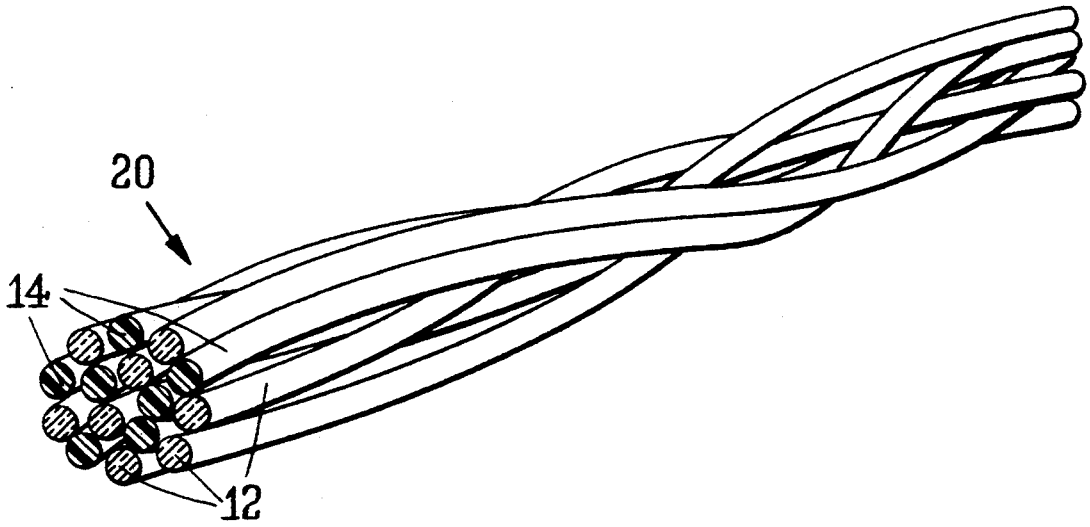
FIG. 10 illustrates a yarn, still further enlarged, produced in accordance with this invention and containing a monofilament combination comprising high-modulus and low-modulus monofilaments.

FIG. 9 illustrates a multifilament yarn 10 in which the filaments 12 are all high-modulus monofilaments, in this case glass monofilaments, whereas FIG. 10 illustrates a multifilament yarn 20 in which the filaments are a combination comprising high-modulus monofilaments 12 (also glass filaments) and low-modulus monofilaments 14, i.e. thermoplastic monofilaments of a low initial modulus (in this case PEEK). The combination of filaments can best be seen from viewing the end of yarn 20, where the ends of filaments 12 and 14 are shown.

What is claimed is:

1. A multifilament yarn comprising high-modulus monofilaments having an initial modulus of more than 50 GPa which have been intermingled, said multifilament yarn having a total linear density of 500–4000 dtex, wherein the average entanglement spacing of the multifilament yarn, measured in the pin count test, is less than 150 mm, and the number of broken monofilament ends, measured by the light barrier method on one side of the multifilament yarn, is less than 20/m.

2. The multifilament yarn of claim 1, wherein said total linear density is 700–3000 dtex, said high-modulus monofilaments have a modulus of more that 80 GPa, the average entanglement spacing is less than 70 mm and the number of broken filaments is less than 0.1/m.

3. The multifilament yarn of claim 1 which consists essentially of said high-modulus monofilaments, wherein the tenacity of said multifilament yarn, after said high-modulus monofilaments have been intermingled, is at least 80% of that of a multifilament yarn of the same high-modulus filaments which has not been intermingled.

4. The multifilament yarn of claim 3, wherein the tenacity of said multifilament yarn, after said high-modulus monofilaments have been intermingled, is more than 100% of a said multifilament yarn which has not been intermingled.

5. The multifilament yarn of claim 1, wherein the high-modulus monofilaments comprise aramid, carbon or glass.

6. The multifilament yarn of claim 1, wherein said multifilament yarn comprises a monofilament combination comprising said high-modulus monofilaments and lower-modulus, thermoplastic monofilaments having a lower initial modulus.

7. The multifilament yarn of claim 6, wherein said lower-modulus, thermoplastic monofilaments comprise polyether ether ketone, polyether imide, polyethylene terephthalate or polyphenylene sulfide.

8. The multifilament yarn of claim 6, wherein said high-modulus monofilaments have been intermingled by subjecting said monofilaments to an intermingling medium having a temperature of 0.25 to 0.9 $T_m$, where $T_m$ is the melting point or the decomposition temperature of the high-modulus monofilaments measured in °C.

9. The multifilament yarn of claim 1, wherein said high-modulus monofilaments have been intermingled by subjecting said monofilaments to an intermingling medium having a temperature of 0.25 to 0.9 $T_m$, where $T_m$ is the melting point or the decomposition temperature of the high-modulus monofilaments measured in °C.

* * * * *